US005498812A

United States Patent [19]

Bradway et al.

[11] Patent Number: 5,498,812

[45] Date of Patent: Mar. 12, 1996

[54] TWO-STAGE PROCESS FOR PRODUCING DIAMONDOID HYDROCARBONS

[75] Inventors: Robert A. Bradway, Voorhees; Larry A. Green, Mickleton; L. Deane Rollmann, Moorestown, all of N.J.

[73] Assignee: Mobil Oil Corporation, Fairfax, Va.

[21] Appl. No.: 285,675

[22] Filed: Aug. 4, 1994

[51] Int. Cl.[6] ..... C07C 13/28

[52] U.S. Cl. ..... 585/352

[58] Field of Search ..... 585/352

[56] References Cited

U.S. PATENT DOCUMENTS

| | | | |
|---|---|---|---|
| 4,952,747 | 8/1990 | Alexander et al. | 585/803 |
| 4,952,748 | 8/1990 | Alexander et al. | 585/803 |
| 4,952,749 | 8/1990 | Alexander et al. | 585/803 |
| 4,982,049 | 1/1991 | Alexander et al. | 585/803 |
| 5,019,660 | 5/1991 | Chapman et al. | 585/22 |
| 5,053,434 | 10/1991 | Chapman | 521/52 |
| 5,080,776 | 1/1992 | Partridge et al. | 208/60 |
| 5,120,899 | 6/1992 | Chen et al. | 585/803 |

*Primary Examiner*—Asok Pal

*Attorney, Agent, or Firm*—Alexander J. McKillop; Dennis P. Santini; Robert B. Furr, Jr.

[57] ABSTRACT

The present invention provides a hydrogenation process for producing diamondoid compounds from a petroleum feedstream containing multiple ring naphthenes comprising the steps of:

(a) converting multiple ring naphthenes to alkyl substituted adamantanes in the presence of a zeolite catalyst having a Constraint Index of less than 1 in a first stage to form an intermediate product stream; and (b) selectively cracking non-diamondoid components of said intermediate product stream in the presence of a zeolite having a CI less than or equal to 2 to evolve a final product stream enriched in alkyl substituted adamantanes.

12 Claims, 3 Drawing Sheets

91% 300°F+ CONVERSION

97% 300°F+ CONVERSION

ADAMANTANE PLUS 1-METHYLADAMANTANE VS.
DI- PLUS TRI-METHYLADAMANTANE

TWO-STAGE PROCESS FOR PRODUCING DIAMONDOID HYDROCARBONS

FIELD OF THE INVENTION

The present invention relates to producing and recovering diamondoid hydrocarbons from petroleum fractions.

BACKGROUND OF THE INVENTION

Adamantane, tricyclo-[3.3.1.1.3,7]decane, is perhaps the simplest of the group of hydrocarbons called diamondoids. It is a polycyclic alkane with the structure of three fused cyclohexane rings. The ten carbon atoms which define the framework structure of adamantane are arranged in an essentially strainless manner. Four of these carbon atoms, the bridgehead carbons, are tetrahedrally disposed about the center of the molecule. The other six (methylene carbons) are octahedrally disposed. Adamantane has been found to be a useful building block in the synthesis of a broad range of organic compounds. U.S. Pat. Nos. 5,019,660 to Chapman and Whitehurst and 5,053,434 to Chapman teach diamondoid compounds which bond through the methylene positions of various diamondoid compounds, including adamantane. For a survey of the chemistry of diamondoid molecules, see *Adamantane, The Chemistry of Diamond Molecules*, Raymond C. Fort, Marcel Dekker, New York, 1976.

Many hydrocarbonaceous mineral streams contain some small proportion of diamondoid compounds, typically less than about 0.1 or even 0.01% by weight. These high boiling, saturated, three-dimensional polycyclic organics are illustrated by adamantane, diamantane, triamantane and various side chain substituted homologues, particularly the methyl derivatives. These compounds have high melting points and high vapor pressures for their molecular weights and have recently been found to cause problems during production and refining of hydrocarbonaceous minerals, particularly natural gas, by condensing out and solidifying, thereby clogging pipes and other pieces of equipment.

The problem of deposition and plugging by solid diamondoids in natural gas production equipment has been successfully addressed by a controlled solvent injection process. U.S. Pat. No. 4,952,748 to Alexander and Knight teaches the process for extracting diamondoid compounds from a hydrocarbon gas stream by contacting the diamondoid-laden hydrocarbon gas with a suitable solvent to preferentially dissolve the diamondoid compounds into the solvent.

Separation of the diamondoid compounds from the diamondoid-enriched solvent is complicated by the fact that numerous diamondoid compounds boil in a narrow range of temperatures surrounding the boiling range of the most preferred solvents. U.S. Pat. Nos. 4,952,747, 4,952,749, and 4,982,049 to Alexander et al. teach various methods of concentrating diamondoid compounds in the solvent for, among other reasons, recycling the lean solvent fraction for reuse. Each of these processes produces an enriched solvent stream containing a mixture of diamondoid compounds. In addition, U.S. Pat. No. 5,120,899 to Chen and Wentzek teaches a particularly useful method for sorbing and isolating diamondoid fractions.

Hydrocracking is a well known process. The catalysts used for hydrocracking comprise an acid component and a hydrogenation component. Most commonly, the hydrogenation component will be a noble metal such as platinum or palladium or non-noble metal such as nickel, molybdenum or tungsten or a combination of these metals. The acidic cracking component may be an amorphous material such as an acidic clay or amorphous silica-alumina or, alternatively, a zeolite. Large pore zeolites such as zeolites X or Y have been conventionally used for this purpose because the principal components of the feedstocks (gas oils, coker bottoms, reduced crudes, recycle oils, FCC bottoms) are higher molecular weight, relatively large hydrocarbons which will not enter the internal pore structure of the smaller pore zeolites and therefore will not undergo conversion.

U.S. Pat. No. 5,080,776 to Partridge et al. teaches a two-stage method for converting diamondoid-containing wash oils, and more specifically diamondoid molecules, to gasoline comprising a first hydrocracking stage and a second reforming stage.

The above-listed U.S. Patents are incorporated by reference as if set forth at length herein for the details of recovering and concentrating diamondoid compounds.

SUMMARY OF THE INVENTION

The present invention provides a two-stage hydrogenation process for producing diamondoid compounds from a petroleum feedstream containing multiple ring naphthenes comprising the steps of:

(a) converting multiple ring naphthenes to alkyl substituted adamantanes in the presence of a zeolite catalyst having a Constraint Index less than 1.0 in a first stage to form an intermediate product stream; and (b) selectively cracking non-diamondoid components of said intermediate product stream in the presence of a zeolite having a Constraint Index less than or equal to about 2 to evolve a final product stream enriched in alkyl substituted adamantanes.

The catalysts useful in steps (a) and (b) above, are referred to herein as Stage 1 and Stage 2 catalysts, respectively. Preferred Stage 1 catalysts are zeolites with CI less than 1 and containing a noble or non-noble metal hydrogenation component. Particularly preferred Stage 1 catalysts contain a faujasite-type zeolite such as zeolite X or zeolite Y. The purpose of the Stage 1 catalyst is to selectively convert multi-ring naphthenes into diamondoid structures and to saturate multi-ring aromatics, if present. In certain applications, Stage 1 in the present invention may be the final recycle stage in a conventional refinery hydrocracking operation.

The Stage 2 catalyst is a zeolite with CI less than or equal to about 2, preferably containing noble or non-noble metal hydrogenation component. The primary function of the Stage 2 catalyst is to selectively convert near-boiling non-diamondoid molecules to lower molecular weight hydrocarbons which can be easily separated from the desired diamondoid product. The most preferred catalyst in Stage 2 is zeolite Beta, containing 0.05 to 2.5% and preferably 0.2 to 1.0% Pt or Pd.

Feedstocks useful in the present invention include but are not limited to petroleum fractions boiling within the range of from about 175° to about 400° C. Narrower fractions, such as a 175°–250° C. cut or a 250°–325° C. cut, for example, may be useful as well. As indicated above, a suitable Stage 1 feed can also be the feed to the last stage in a conventional refinery hydrocracking operation, and could therefore contain S and N impurities.

Suitable Stage 2 feedstocks will contain very little S and N, preferably less than 2000 ppm S and less than 200 ppm N. More preferred are feedstocks containing less than about 200 ppm S and 20 ppm N, and most preferred are those with less than about 20 ppm S and less than 5 or even less than 1 ppm N. They will also contain at least 1% and preferably at least 5 to 10% three-ring naphthene and diamondoid. At the upper extreme, they may contain as much as 90 or 95% diamondoid and diamondoid precursor. A narrow boiling range fraction is preferred in Stage 2, such as the 175°–250° or 250°325° C. cuts noted above, but broader petroleum fractions such as heavy naphthas and distillates are suitable as well.

The compositions of three suitable Stage 2 feeds, a heavy naphtha and two distillates, are shown below, by way of example.

| Component | Heavy Naphtha | Distillate A | Distillate B |
|---|---|---|---|
| Boiling Range | 130–215° C. | 175–265° C. | 170–390° C. |
| Sulfur, ppm | <5 | <5 | 11 |
| Nitrogen, ppm | <1 | <1 | <2 |
| Paraffins | 15 wt. % | 24 wt. % | 27 wt. % |
| 1-ring naphthenes | 53 | 21 | 19 |
| 2-ring naphthenes | 11 | 13 | 12 |
| 3-ring naphthenes | 1 | 27 | 24 |
| Alkyl benzenes | 18 | 7 | 6 |
| Other Aromatics | 2 | 8 | 12 |

The first reaction stage in the process of this invention converts at least a portion of the feedstock into three-dimensional polycyclic alkanes, including diamondoids. When the endpoint of the feedstock is below about 250° C., the diamondoids evolved in the first reaction stage typically include alkyl-substituted adamantanes, as well as adamantane itself. Higher boiling feedstocks containing higher molecular weight polycyclic alkanes tend to favor the formation of higher molecular weight diamondoids, such as alkyl-substituted diamantanes and triamantanes.

When Stage 1 is the final stage in a conventional refinery hydrocracking operation, suitable reaction conditions are given below, and provision will normally be made to remove product $NH_3$ or $H_2S$ prior contact with the Stage 2 catalyst. Even milder conditions and lower pressure can be appropriate with low-S and low-N streams or with lighter streams, i.e., streams having endpoints below about 325° C.

| | First Stage Conversion Conditions | | |
|---|---|---|---|
| | Useful | Typical | Preferred |
| Temperature, °C. | 275 to 450 | 300 to 425 | 325 to 400 |
| Pressure, psig | 500 to 3000 | 750 to 2000 | 1000 to 1500 |
| WHSV, $hr.^{-1}$ | 0.1 to 4.0 | 0.3 to 2.0 | 0.5 to 1.0 |

When the feed to Stage 1 does not contain N or S impurities, the first reaction stage effluent may be charged directly to the Stage 2 catalyst without intermediate product separation. In this situation, it may be possible to use the same catalyst in both Stages 1 and 2 and to combine the two Stages in a single reaction vessel. More often, it will be advantageous economically to separate and remove valuable gasoline-range and other light hydrocarbons following Stage 1, usually by fractionation. Such interstage separation is also helpful because it concentrates the diamondoids for subsequent purification in Stage 2.

In the second reaction stage, near-boiling non-diamondoid components which are present in the first stage reaction effluent are selectively converted to lower-boiling constituents which are then more easily separated from the desired diamondoid product. In order to enhance selectivity, process conditions for the second stage are preferably mild conditions of temperature, space velocity and hydrogen pressure relative to those used, for example, in a conventional refinery hydrocracking operation. Stage 2 conditions are only sufficiently strenuous to transform any unreacted diamondid precursor from Stage 1 into product, to saturate any near-boiling aromatics, and to selectively convert near-boiling naphthenes and paraffins to lighter hydrocarbons. They are not so strenuous as to convert substantially the desired diamondoid product.

Stage 2 of this invention may optionally be used to purify a diamondoid-containing hydrocarbon stream from other sources, for example, to concentrate adamantanes and diamantanes in the reactor effluent of a diamondoid synthesis process.

| | Second Stage Conversion Conditions | | |
|---|---|---|---|
| | Useful | Typical | Preferred |
| Temperature, °C. | 200 to 425 | 225 to 400 | 250 to 375 |
| Pressure, psig | 100 to 1500 | 200 to 1000 | 300 to 600 |
| WHSV, $hr.^{-1}$ | 0.2 to 8 | 0.5 to 5 | 1 to 3 |
| Hydrogen dosage, SCF/BBL | 500 to 10,000 | 1000 to 6000 | 2000 to 4000 |

Suitable Stage 1 and Stage 2 catalysts include those solids having relatively large pores which exhibit both acid and hydrogenation functions. The large pore size is critical in Stage 1 in order to allow large polycyclic naphthenes access to the internal pore system of the solid catalyst where they can be converted to diamondoids. It is critical in Stage 2 for the conversion of large near-boiling non-diamondoid molecules into lower-boiling and readily separable light hydrocarbon. It is also helpful in Stage 2 in allowing any large polycyclic diamondoid precursor molecules remaining after Stage 1 to access the internal pore structure of the solid catalyst and be converted to diamondoid product.

The acid function is therefore suitably provided either by a large pore, amorphous material such as alumina, silica-alumina, or silica, or by a large pore size aluminosilicate zeolite characterized by a Constraint Index of less than about 1 in Stage 1 and less than 2 in Stage 2, examples of which include mordenite, TEA mordenite, zeolite X, zeolite Y, ZSM-4, ZSM-12, ZSM-20, ZSM-38, ZSM-50, REX, REY, and Beta. The zeolites may be used in their various forms, for example, their cationic forms, preferably cationic forms of enhanced hydrothermal stability to resist the irreversible loss of the acid function upon exposure to the relatively severe conditions attendant to hydrocracking. For this reason, rare earth exchanged large pore zeolites such as REX and REY are generally preferred, as are ultra-stable zeolite Y (USY) and high silica zeolites such as dealuminized Y or dealuminized mordenite. These solids are particularly preferred as Stage 1 catalyst components when Stage 1 is the final stage in a conventional refinery hydrocracking operation.

While all of these large-pore solids are effective Stage 2 catalyst components, zeolite Beta is preferred. Zeolite Beta is taught in U.S. Pat. Nos. 4,696,732; 3,308,069, as well as U.S. Pat. No. Re. 28,341, the entire contents of which are incorporated by reference as is set forth at length herein.

A convenient measure of the extent to which a zeolite provides control to molecules of varying sizes to its internal structure is the Constraint Index of the zeolite. The method by which the Constraint Index is determined is described in U.S. Pat. No. 4,016,218, incorporated herein by reference for details of the method. U.S. Pat. No. 4,696,732 discloses Constraint Index values for typical zeolite materials and is incorporated by reference as if set forth at length herein.

Constraint Index (CI) values for some typical materials are shown below.

| | CI (at test temperature) |
|---|---|
| ZSM-4 | 0.5 (316° C.) |
| ZSM-5 | 6–8.3 (371° C.–316° C.) |
| ZSM-11 | 5–8.7 (371° C.–316° C.) |
| ZSM-12 | 2.3 (316° C.) |
| ZSM-20 | 0.5 (371° C.) |
| ZSM-22 | 7.3 (427° C.) |
| ZSM-23 | 9.1 (427° C.) |
| ZSM-34 | 50 (371° C.) |
| ZSM-35 | 4.5 (454° C.) |
| ZSM-38 | 2 (510° C.) |
| ZSM-48 | 3.5 (538° C.) |
| ZSM-50 | 2.1 (427° C.) |
| TMA Offretite | 3.7 (316° C.) |
| TEA Mordenite | 0.4 (316° C.) |
| Clinoptilolite | 3.4 (510° C.) |
| Mordenite | 0.5 (316° C.) |
| REY | 0.4 (316° C.) |
| Amorphous Silica-alumina | 0.6 (538° C.) |
| Dealuminized Y | 0.5 (510° C.) |
| Erionite | 38 (316° C.) |
| Zeolite Beta | 0.6–2.0 (316° C.–399° C.) |

The above-described Constraint Index provides a definition of those zeolites which are useful in the instant invention. The very nature of this parameter and the recited technique by which it is determined, however, admit of the possibility that a given zeolite can be tested under somewhat different conditions and thereby exhibit different Constraint Indices. Constraint Index seems to vary somewhat with severity of operations (conversion) and the presence or absence of binders. Likewise, other variables, such as crystal size of the zeolite, the presence of occluded contaminants, etc., may affect the Constraint Index. Therefore, it will be appreciated that it may be possible to so select test conditions, e.g. temperature, as to establish more than one value for the Constraint Index of a particular zeolite. This explains the range of Constraint Indices for some zeolites, such as ZSM-5, ZSM-11 and Beta.

The hydrogenation function is provided by a metal or combination of metals. Noble metals of Group VIIIA of the Periodic Table, especially platinum or palladium may be used, as may base metals of Groups IVA, VIA and VIIIA, expecially chromium, molybdenum, tungsten, cobalt and nickel. Combinations of metals such as nickel-molybdenum, cobalt-molybdenum, cobalt-nickel, nickel-tungsten, cobalt-nickel-molybdenum, and nickel-tungsten-titanium have also been shown to be effective. The non-noble metals are often used in the form of their sulfides.

In practicing conversion processes using the catalyst of the present invention, it may be useful to incorporate the above-described crystalline zeolites with a matrix comprising another material resistant to the temperature and other conditions employed in such processes. Such matrix materials include synthetic or naturally occurring substances as well as inorganic materials such as clay, silica and/or metal oxides, most notably aluminum oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaolins commonly known as Dixie, McNamee-Georgia and Florida clays or others in which the main mineral constitutent is halloysite, kaolinite, dickite, nacrite or anauxite. Such clays can be used in the raw state as originally mined or initially subjected to calcination, acid treatment or chemical modification.

In addition to the foregoing materials, the zeolites employed herein may be composited with a porous matrix material, such as alumina, silica-alumina, silica-magnesia, silica-zirconia, silica-thoria, silica-beryllia, and silica-titania, as well as ternary compositions, such as silica-alumina-thoria, silica-alumina-zirconia, silica-alumina-magnesia and silica-magnesia-zirconia. The matrix may be in the form of a cogel. The relative proportions of zeolite component and inorganic oxide gel matrix, on an anhydrous basis, may vary widely with the zeolite content ranging from between about 1 to about 99 percent by weight and more usually in the range of about 50 to about 90 percent by weight of the dry composite.

Additional catalyst modifying procedures which may also optionally be employed to modify catalyst activity or selectivity include precoking and presteaming, or combinations thereof. Pre-steaming, preferably conducted at 400°–550° C. for 1–24 hours and with 10–100% steam, generally alters zeolite catalyst activity and selectivity.

EXAMPLES

The feedstocks tested in this series of experiments were: (1) a hydrocracker splitter bottoms (recycle) stream (<2 ppm N, 11 ppm S), (2) a vacuum-distilled 350°–500° F. cut from the hydrocracker splitter bottoms stream (45 wt % of the splitter bottoms), (3) a 300°–400° F. heavy naphtha distilled from full-range hydrocracker product naphtha, (4) a cat-feed hydrotreater (CFHD) kerosene, and (5) a 350°–550° F. cut from a second-stage hydrocracker feed. The base feed for blend experiments was feed No. 3, the 300°–400° F. heavy naphtha, to which were added either pure compounds (perhydrofluorene or adamantane) or another refinery stream. The pure compounds were obtained from Aldrich Chemical and were used without further purification.

The Examples focus on Stage 2 behavior under the following operating conditions:

All catalysts were 24/60 mesh, all contained 0.4–0.6% Pt or Pd, 60–70% zeolite, and 30–40% alumina binder, all were pre-reduced in flowing hydrogen at 550° F. and 350 psig for 2 hours, and all were first contacted with heavy naphtha at 250° F. Under the test conditions of these experiments (490°–620° F., 350 psig, 3–4 $H_2$/HC), heavy naphtha was 100% gas-phase.

Two sets of Pd and Pt catalysts were used in the experiments, the difference being their presteaming and/or time-on-stream history and thus their activity for heavy naphtha conversion. A "high activity" catalyst was one able to effect about 90% 300° F.+ conversion of the heavy naphtha at 490°–520° F. and 2 WHSV. A "moderate activity" catalyst required 570°–620° F. Balances were 18–24 hours in duration, and none of the catalysts had been on stream for less than a week prior to the experiments reported herein. Both faujasite-type and Beta zeolites were used.

The gc-mass spec analyses were performed on a Kratos Model MS80RFA, with a Hewlett Packard Series II 5890 gc and a 30 m DB-5HT capillary column (J&W Scientific, 0.32 mm id, 0.1 μfilm). Ionization was by electron impact.

Adamantanes from refinery streams. The potential presence of diamondoids and diamondoid precursors in a refinery stream was most clearly demonstrated with 350°–700° F. hydrocracker splitter bottoms, a stream which contained about 25 wt. % diamondoid precursors and diamondoids, and which would represent a suitable Stage 2 feed wherein Stage 1 was the final stage in a conventional refinery hydrocracking operation. When this stream was passed over Pt-Beta catalyst at 620° F. and 1.2 WHSV, 90% of the feed was converted to hydrocarbon boiling below 350° F. The remaining material was approximately 75% adamantanes. Its gc trace is shown in FIG. 1A.

Figure 1A:
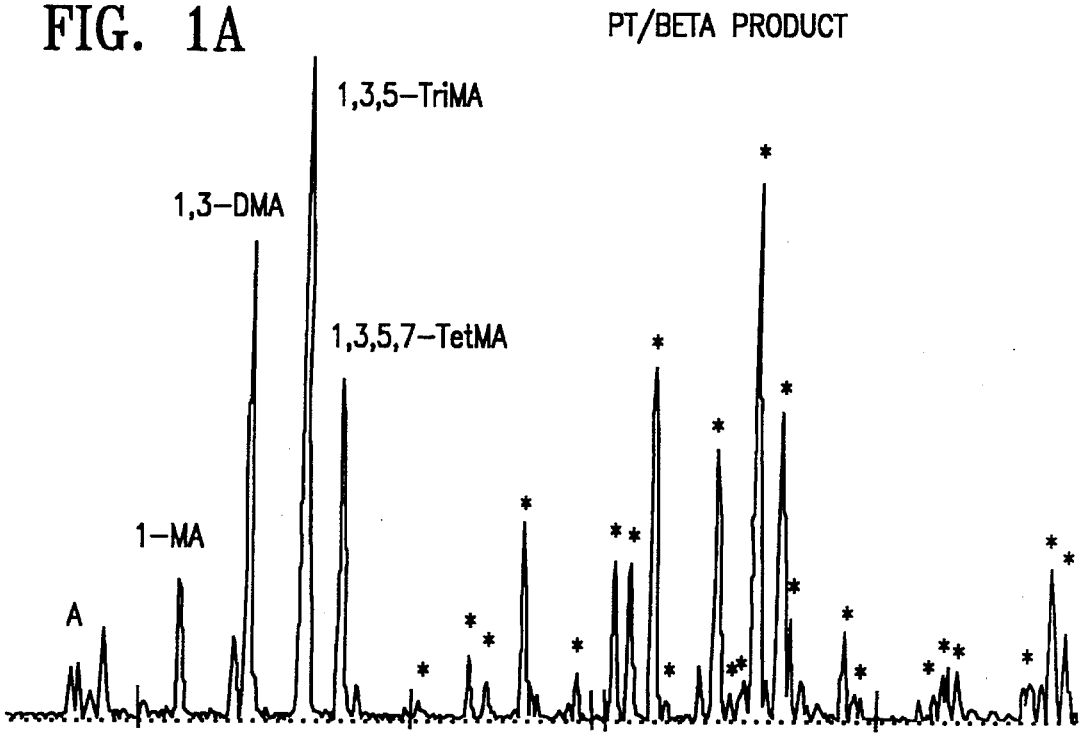
FIG. 1A is a gas chromatogram of the material remaining (approximately 75% adamantanes) from processing hydrocracker splitter bottoms over Pt-Beta catalyst at 620° F. (327° C.) and 1.2 WHSV to convert 90% of the feed to hydrocarbon boiling below 350° F. (177° C.).
Figure 1B:
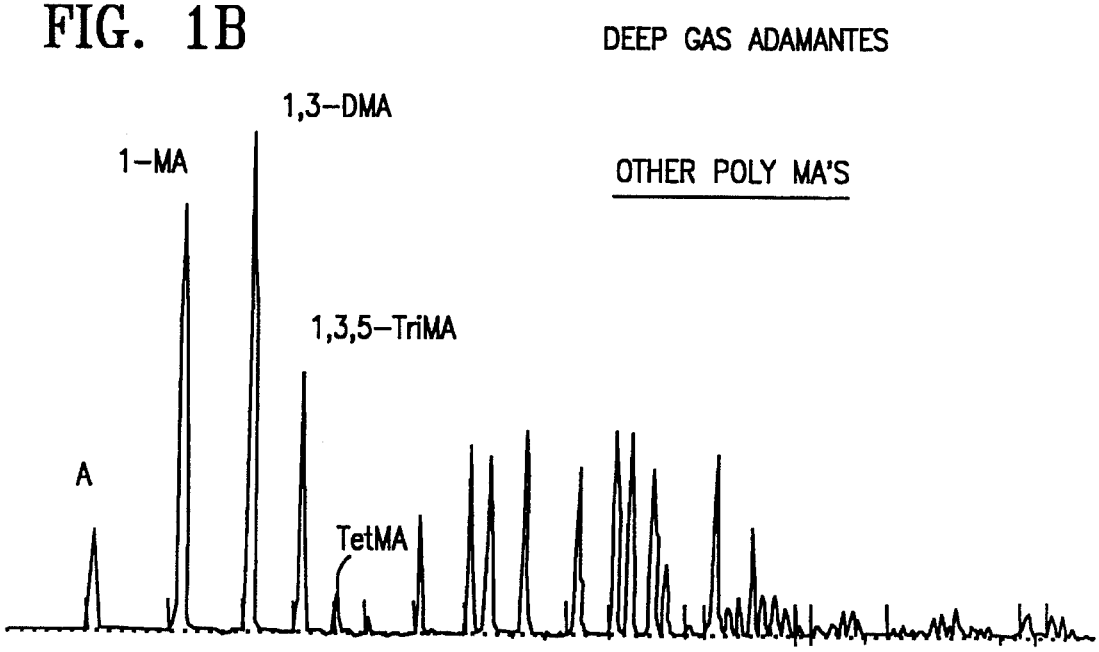
FIG. 1B is a gas chromatogram of a mixture of adamantanes produced from a deep gas reservoir.

Comparison of the gc trace in FIG. 1A with FIG. 1B (an authentic mixture of adamantanes produced from a deep gas reservoir) confirmed identification of the peaks as adamantanes. Despite the understandable difference in isomer distribution, given the totally different source of the two materials, every major peak in the product from the Pt-Beta corresponded to a peak in the deep gas reservoir sample. Gc-mass spec identified all of the major peaks in FIG. 1 as having molecular weights corresponding to alkyl (methyl and ethyl) adamantanes. Both gc and gc-mass spec also showed the significant presence of diamantanes in the product, an observation consistent with the relatively high endpoint of the feed.

Adamantanes free from diamantanes were obtained by using a lower endpoint portion of the hydrocracker recycle stream. When the experiments were repeated with a 350°–500° F. fraction of the hydrocracker stream, this time using an aged Pd/zeolite Beta at 598° F. and 2.0 WHSV, conversion to lighter hydrocarbon was 90%. A gc trace of the material boiling above 350° F. is given in FIG. 2. It contained over 90% adamantanes. As shown, the product mixed methyl (and ethyl) adamantanes were virtually indistinguishable from those produced over Pt/zeolite Beta with full-range hydrocracker recycle. Material boiling higher than the mixed methyl adamantanes (e.g., diamantanes) represented <0.1% of the product.

Figure 2A:
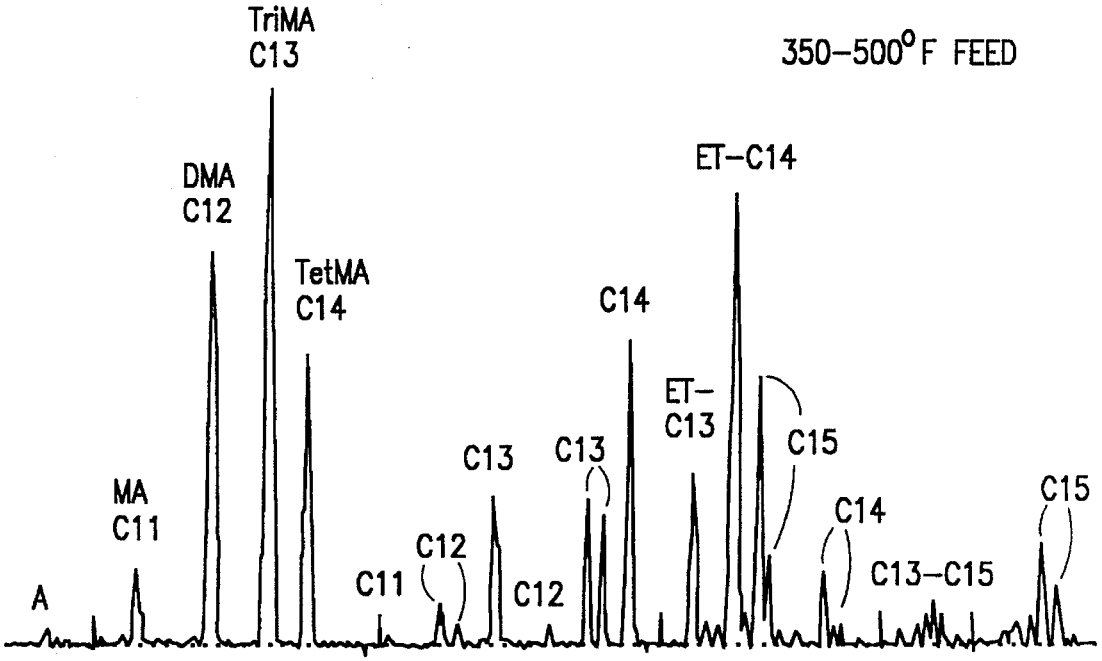
FIG. 2 is a gas chromatogram of the material boiling above 350° F. produced by reacting (a) the 350°–500° F. (177°–260° C.) fraction of a hydrocracker stream and (b) the full hydrocracker stream in the presence of an aged Pd/zeolite Beta at 598° F. (314° C.) and 2.0 WHSV at a conversion to lighter hydrocarbon of 90%.
Figure 2B:
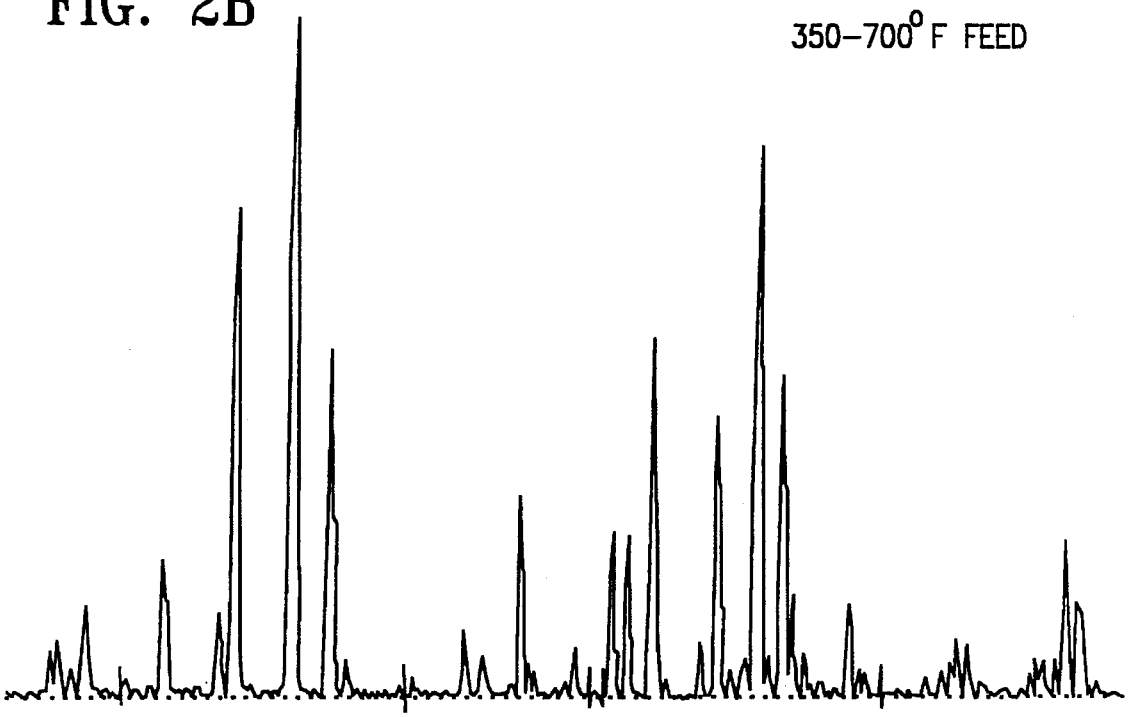

Isomer assignments are made in FIG. 2 only for those adamantanes containing methyl groups on the bridgehead carbons, namely, unsubstituted and mono-through tetramethyladamantanes (A, 1-MA, 1,3-DMA, etc.). Molecular weight (carbon number) is listed for the remaining peaks. Fragmentation patterns confirmed that the alkyls were methyl and, to some extent, ethyl groups. None of the major peaks in FIG. 2 had a molecular weight above 206, corresponding to pentamethyl- and/or ethyltrimethyladamantane.

Mixed methyl adamantane yields were very similar for the two feeds. With the lighter feed, approximately 9.1 g of mixed methyl adamantanes was obtained from 100 g of feed, representing 32% yield based on three-ring naphthene (adamantanes and adamantane precursors) in the feed. A second experiment, under slightly milder conditions (585° F., 2.5 WHSV), yielded 9.3 g of mixed methyl adamantanes, or 33%. In two experiments with full-range feed and Pt-Beta catalysts, the yield averaged 29% based on three-ring naphthenes.

That the mixed methyl adamantanes were associated with the recycle stream and that alternative boiling range feeds can be used in this invention was further demonstrated by blending the 350°–500° F. recycle 1:1 (wt) with 300°–400° F. heavy naphtha from the hydrocracker (Feed No. 2 plus Feed No. 3). Over high activity Pt-Beta catalyst at 493° F. and 1.9 WHSV, the yield of mixed methyl adamantanes was 37% based on three-ring naphthenes, and the product isomer distribution was virtually indistinguishable from that obtained with the recycle stream alone. The product mixed methyl adamantane, separated from lower boiling hydrocarbons by distillation, was a colorless liquid with a density of 0.89 g/cc.

When the above experiment was repeated with Pd-Beta instead of Pt-Beta catalyst, mixed methyl adamantanes yield was very similar, 40% based on three-ring naphthenes (6.1% based on total feed). A "blank" experiment with Pt/zeolite Beta and heavy naphtha alone yielded a product containing 0.6% mixed methyl adamantanes (based on total feed) which were generated from the 1–2% three-ring naphthenes (and possibly adamantanes) in the heavy naphtha.

That the adamantanes were not an artifact of unusual unit operation or feed was demonstrated by repeating the experiment with a second hydrocracker recycle sample taken when the unit was operating on a different feed. A blend of the 350°–500° F. portion of this stream with heavy naphtha, passed over Pd/zeolite Beta at 590° F. and 2.3 WHSV, yielded 23% mixed methyl adamantanes, based on three-ring naphthenes. Conversion of 350° F.+ materials was 93%.

That the chemistry was not specific to zeolite Beta but was general to large-pore zeolites with CI less than about 2 was shown by experiments with USY. When the Feed No. 2/heavy naphtha blend was processed over a Pd/USY catalyst at 570° F. and 0.9 WHSV, mixed methyl adamantanes yield was 36% based on three-ring naphthenes. A second experiment, at 588° F. and 1.8 WHSV, showed a very similar yield, 33%.

The chemistry was also not an artifact of the refinery or the feedstock, although the 3-ring naphthene concentration can vary substantially from one operation to another. When a hydrocracker recycle stream from a different refinery, operating with a different crude, was blended with heavy naphtha and processed over Pt-Beta catalyst at 510° F. and 1.8 WHSV, the product contained 0.9% mixed methyl adamantanes, corresponding to a yield of 35% based on three-ring naphthenes in the new hydrocracker recycle stream and when corrected for heavy naphtha. The isomer distribution was very similar to that shown in FIG. 2 except that 1,3-dimethyladamantane, rather than 1,3,5-trimethyladamantane, was the major adamantane derivative in the product.

Finally, an experiment was conducted with a hydrotreated kerosene, a 250°–470° F. stream, which contained only 0.6% three-ring naphthenes. When processed over Pd/zeolite Beta at 510° F. and 2.0 WHSV, the product contained ≦0.5% mixed methyl adamantanes (based on total feed). This experiment showed that, in the absence of three-ring naphthene, very little adamantane was formed.

Adamantanes from pure compounds. Model compounds were used to help select a most preferred zeolite for the Stage 1 and Stage 2 catalysts. Perhydrofluorene was selected as the model three-ring naphthene for Stage 1, and unsubstituted adamantane was chosen as a test molecule for product stability under the Stage 2 process conditions. Pt and Pd/Beta and USY were then compared.

Perhydrofluorene conversion to mixed methyl adamantanes was observed with zeolite Beta but was limited, for reasons which will be discussed below. With perhydrofluorene, dissolved at 10% in HDC heavy naphtha and processed over Pd-Beta at 580° F. and 2.0 WHSV, the yield of mixed methyl adamantanes based on perhydrofluorene was 3%. Perhydrofluorene conversion was 100%.

USY was more effective as a Stage 1 catalyst (although somewhat more severe reaction conditions were used in this test). When perhydrofluorene experiment was repeated over Pd/USY (but at 610° F. and 1.7 WHSV), the product contained 3.5% mixed methyl adamantanes which, when corrected for the heavy naphtha contribution, represented approximately 27% yield based on perhydrofluorene. Gc-mass spec showed four new non-bridgehead products, all $C_{13}$ mixed methyl adamantanes, and 1,3,5-trimethyladamantane was enhanced in concentration relative to the other bridgehead isomers. Perhydrofluorene, a $C_{13}$ molecule, was again 100% converted.

Experiments with unsubstituted adamantane confirmed the greater stability of the diamondoid structure, in relation to the other molecules in a heavy naphtha or a light distillate (decalins, paraffins, alkylcyclohexanes, etc.) and showed that Beta is preferred over USY as a Stage 2 catalyst component.

| Feed | Heavy Naphtha | +10% Adamantane | +10% Adamantane | Heavy Naphtha |
|---|---|---|---|---|
| Temp. °F. | 492 | 491 | 491 | 493 |
| WHSV | 1.9 | 2.1 | 1.0 | 2.0 |
| 350° F. + Conv. | 91% | 79% | 95% | 87% |
| Adamantane Conv. | — | 33% | 75% | — |

Figure 3A:
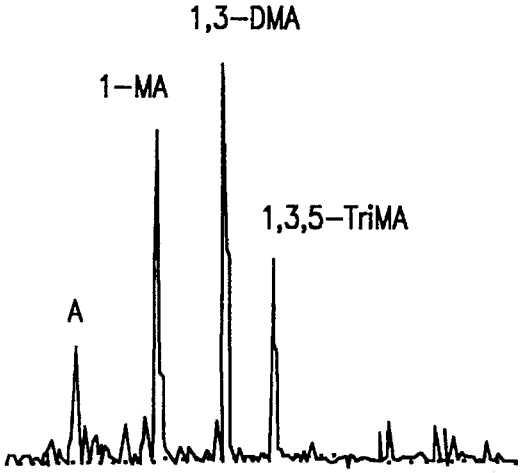
FIG. 3A is a gas chromatogram of the mixed methyl adamantanes produced by reacting a hydrocracker heavy naphtha over Pd-zeolite Beta at 91% conversion.
Figure 3B:
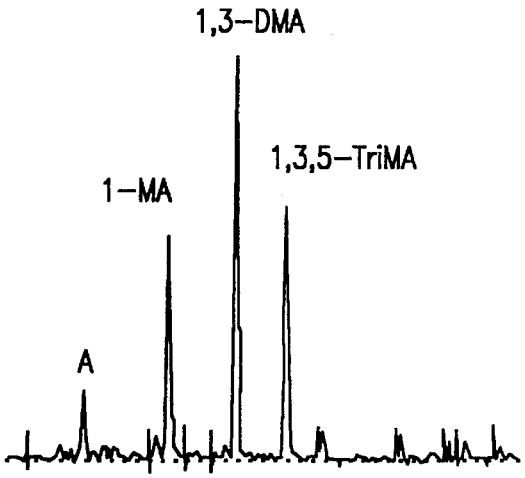
FIG. 3B is a gas chromatogram of the mixed methyl adamantanes produced by reacting a hydrocracker heavy naphtha over Pd-zeolite Beta at 97% conversion.
Figure 3C:
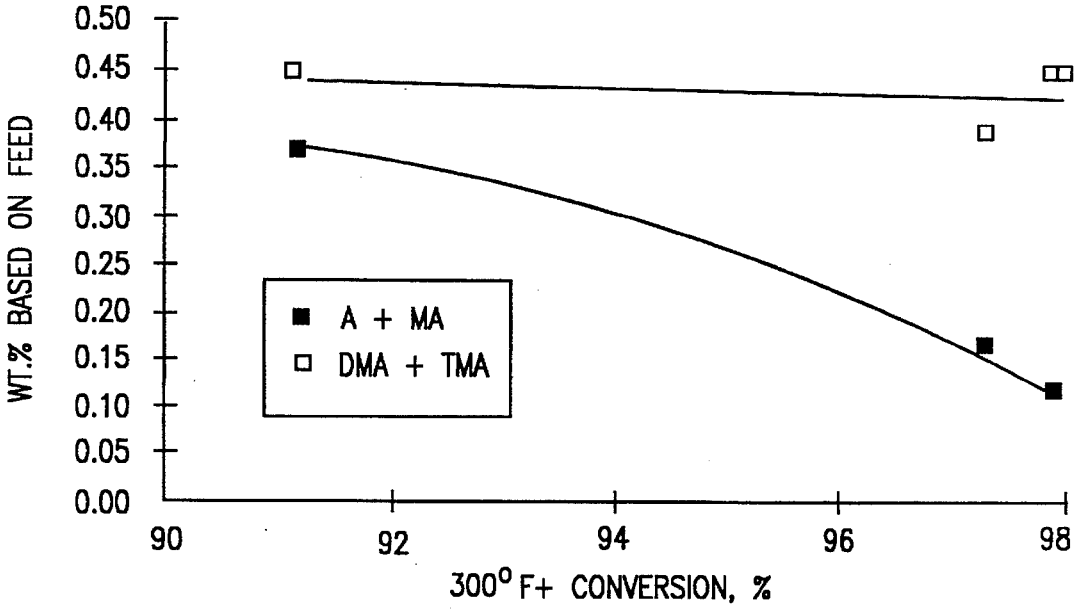
FIG. 3C shows diamondoid selectivity as a function of the conversion of feedstock boiling at or above 300° F. (149° C.).

Mixed methyl adamantanes examples, provided by high-conversion experiments with heavy naphtha and Pt/Beta, showed that the product diamondoids of this invention are even more resistant to conversion in Stage 2 than was indicated by the experiments with adamantanes. As shown by the plots in FIG. 3, only the smallest of the diamondoids, adamantane and 1-methyladamantane, were converted, i.e., presumably because only the smallest had access to the zeolite Beta pore system. With USY's, at the same heavy naphtha conversion levels, the relationship was reversed. The larger mixed methyl adamantanes were preferentially converted.

These experiments with pure compounds thus further confirm that USY is preferred zeolite component for Stage 1 while Beta is preferred Stage 2.

Changes and modifications in the specifically described embodiments can be carried out without departing from the scope of the invention which is intended to be limited only by the scope of the appended claims.

We claim:

1. A two-stage hydrogenation process for producing diamondoid compounds from a petroleum feedstream containing multiple ring naphthenes comprising the steps of:

(a) converting multiple ring naphthenes to alkyl substituted adamantanes in the presence of a zeolite having a Constraint Index of less than 1 in a first stage to form an intermediate product stream; and (b) selectively cracking non-diamondoid components of said intermediate product stream in the presence of a zeolite having a Constraint Index of less than or equal to about 2 to evolve a final product stream enriched in alkyl substituted adamantanes.

2. The process of claim 1 wherein said zeolite catalysts have the structure of at least one selected from the group consisting of zeolite X, zeolite Y, zeolite REX, zeolite REY, zeolite USY, ZSM-4, ZSM-20, ZSM-12, ZSM-38, ZSM-50, zeolite Beta and mordenite and TEA mordenite.

3. The process of claim 1 wherein said catalyst of step (a) comprises a zeolite having the faujasite-type structure.

4. The process of claim 3 wherein said zeolite is USY.

5. The process of claim 1 wherein said catalyst of step (a) contains a hydrogenation component.

6. The process of claim 5 wherein hydrogenation component is one or more of Group 4A, 6A and 8A.

7. The process of claim 6 wherein said hydrogenation component is Pt or Pd.

8. The process of claim 6 wherein said hydrogenation component is selected from the group consisting of Co, Ni, Mo, W and combination thereof.

9. The process of claim 1 wherein the catalyst of step (b) comprises zeolite Beta.

10. The process of claim 1 wherein the catalyst of step (b) contains a hydrogenation component.

11. The process of claim 10 wherein the hydrogenation component of the catalyst of step (b) is selected from group 4A, 6A and 8A.

12. The process of claim 11 wherein said hydrogenation component is Pt or Pd.

* * * * *